US008776331B2

(12) United States Patent
Poulakis

(10) Patent No.: US 8,776,331 B2
(45) Date of Patent: Jul. 15, 2014

(54) MECHANICAL CLOSURE PART

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 92 days.

(21) Appl. No.: 13/138,981

(22) PCT Filed: May 4, 2010

(86) PCT No.: PCT/EP2010/002704

§ 371 (c)(1),
(2), (4) Date: Nov. 8, 2011

(87) PCT Pub. No.: WO2011/100999

PCT Pub. Date: Aug. 25, 2011

(65) Prior Publication Data

US 2012/0047694 A1 Mar. 1, 2012

(30) Foreign Application Priority Data

May 13, 2009 (DE) ..... 10 2009 021 094

(51) Int. Cl.
*A44B 18/00* (2006.01)

(52) U.S. Cl.
USPC ..... 24/449; 24/445

(58) Field of Classification Search
USPC ..... 24/442, 449, 452, 443, 444, 445, 446, 24/447, 448, 450, 451; 428/100
See application file for complete search history.

(56) References Cited

U.S. PATENT DOCUMENTS

| | | | | | |
|---|---|---|---|---|---|
| 3,320,649 | A | * | 5/1967 | Naimer | 28/161 |
| 5,457,855 | A | * | 10/1995 | Kenney et al. | 24/445 |
| 5,625,929 | A | * | 5/1997 | Hattori et al. | 24/452 |
| 5,659,930 | A | * | 8/1997 | Okawa | 24/445 |
| 5,813,095 | A | * | 9/1998 | Robertson | 24/442 |
| 5,852,855 | A | * | 12/1998 | Mody et al. | 24/445 |

FOREIGN PATENT DOCUMENTS

| | | |
|---|---|---|
| DE | 94 12 526 | 12/1995 |
| DE | 102 40 986 | 2/2004 |
| DE | 698 16 123 | 5/2004 |
| DE | 10 2004 053 469 | 5/2006 |
| DE | 10 2006 039 579 | 3/2008 |
| DE | 60 2005 002 542 | 6/2008 |
| WO | WO 94/23610 | 10/1994 |

* cited by examiner

*Primary Examiner* — Robert J Sandy
*Assistant Examiner* — Michael Lee
(74) *Attorney, Agent, or Firm* — Roylance, Abrams, Berdo & Goodman LLP

(57) ABSTRACT

A mechanical closure part includes a support part and a plurality of closure elements extending away from the support part via stems and provided with head parts (2) on their free ends. The closure elements are subdivided on the support part into groups (4) which form a fictitious annular arrangement in the form of a multi-cornered element having corners equipped with a closure element. A group of closure elements (6) is formed within the respective groups (4) with their head parts (2), in the non-actuated state of the closure, adjoining each other in an adjacent manner.

22 Claims, 3 Drawing Sheets

MECHANICAL CLOSURE PART

FIELD OF THE INVENTION

The invention relates to a mechanical closure part comprising a backing and a plurality of adhesive elements extending away from the backing via stems. On their free ends each stem is provided with a head part. The adhesive elements on the backing are arranged to be able to be subdivided into groups forming an imaginary ring arrangement in the form of a polygon with corners occupied by an adhesive element.

BACKGROUND OF THE INVENTION

Such touch-and-close fastener parts are a component of touch-and-close fasteners, as have become widely known under the trademark name "Kletten." The adhesive elements are joined with their stems to the backing and form, with their head parts, closure bodies which can preferably have the shape of mushroom heads, but also of hooks or loops. The adhesive elements with stem lengths, often less than 1 mm, are arranged distributed densely packed on the backing such that the interlocking bodies of the head parts engage the mating elements of another touch-and-close fastener part, which completes the touch-and-close fastener by interlocking.

One of the criteria for good performance characteristics of touch-and-close fasteners is that for actuating the closure, the interlocking engagement takes place securely and easily even if, in the effort to make available a high holding force of the actuated closure, the adhesive elements are arranged very densely packed on the backing. The demands for high packing density and for ease of actuation of the closure with low expenditure of force are, however, mutually conflicting.

If the touch-and-close fastener parts are placed against one another for closure actuation, a certain probability exists that head parts of one part will meet head parts of the other part flush with each other. To achieve interlocking engagement, a type of displacement to clear the engagement path must take place. Especially for high packing density, a correspondingly high actuating force is then necessary. If high actuating forces are tolerated, which is acceptable in certain applications, in the actuated state often such high holding forces result so that an easy release of the actuated fastener is prevented or made difficult.

With respect to this problem, prior art adhesive elements are on the backing in a pattern arrangement deviating from a regular matrix. In this respect, DE 603 10 529 T2 discloses a touch-and-close fastener part in which the adhesive elements are arranged in groups of four adhesive elements each, with the adhesive elements of each group being located on the corners of an almost square rectangle.

A generic touch-and-close fastener part is disclosed in DE 94 12 526 U1. The known touch-and-close fastener part or fastening part has a base and several essentially pin-shaped anchoring elements provided with heads. The anchoring elements are adjacent to one another and project from the base. A group of first anchoring elements is located at positions on the surface of the base such that they form the corner points of essentially regular hexagonal patterns. The arrangement of the first anchoring elements is determined by a basic pattern defined by regular hexagons bordering one another and having one side or corner in common, or defined by concentric circles. Furthermore, in each of the polygonal patterns, at least one second anchoring element is in a position offset from the center point. In this way, a fastening device with fastening parts exhibiting anchoring elements is formed having a relatively high retaining force even in the shear direction.

SUMMARY OF THE INVENTION

An object of the invention is to make available an improved touch-and-close fastener part characterized by especially good performance characteristics with reference to safe and convenient actuation with low expenditure of force required for interengagement and with the holding forces desired at the time being implemented.

This object is basically achieved according to the invention by a touch-and-close fastener part having one adhesive element grouping at a time being formed within the groups in the form of a polygonal ring arrangement with corners occupied by adhesive elements. The head parts of the grouping adjacently meet one another in the unactuated state of the touch-and-close fastener. Such pattern arrangement, in which both groupings with adhesive elements meeting on the head side and in which also "freely standing" adhesive elements are contained, enables an optimum compromise between the required actuating force and the resulting holding force, especially at the high packing density of the adhesive elements which is the goal.

Preferably, the adhesive elements are arranged on the backing with a packing density of at least 150/cm$^2$.

With respect to the groupings with adhesive elements meeting on the head side, the arrangement can be made such that the adhesive element groupings are formed by pairs of adhesive elements or from three adhesive elements.

In groupings formed from pairs of adhesive elements, each group can have preferably at least six corners occupied by an adhesive element. In each group, the adhesive elements of at least two corners form a pair of adhesive elements with adjoining head parts.

Preferably, the adhesive elements have head parts in the shape of mushroom heads.

The material for the adhesive elements is preferably isotactic polypropylene.

With groupings of adhesive elements in the form of pairs of adhesive elements, preferably the groups of adhesive elements form hexagons with unequal sides with two groupings of adhesive elements each, with pairs of adhesive elements adjoining their head parts.

Especially good performance characteristics can be achieved when the individual adhesive elements, which are located between the pairs of adhesive elements of the groups, have a greater distance from one another than from the respectively adjacent pairs of adhesive elements.

According to DE 102 40 986 B3, the backing can be formed from warp, weft, and pile threads, especially in the form of a W-weave. The loops of the pile threads, which project over the base fabric, are cut off. The thread ends formed in this way are thermally treated to form adhesive elements with head parts in the form of interlocking bodies, especially in the shape of a mushroom head.

The arrangement can advantageously be made such that the warp and weft threads are multifilaments and that the pile thread, made preferably as monofilament, has a diameter of approximately 0.20 mm.

In especially advantageous exemplary embodiments, the warp threads and weft threads have 200 and 110 dtex, the pickage for the weft threads being approximately 23 picks/cm.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
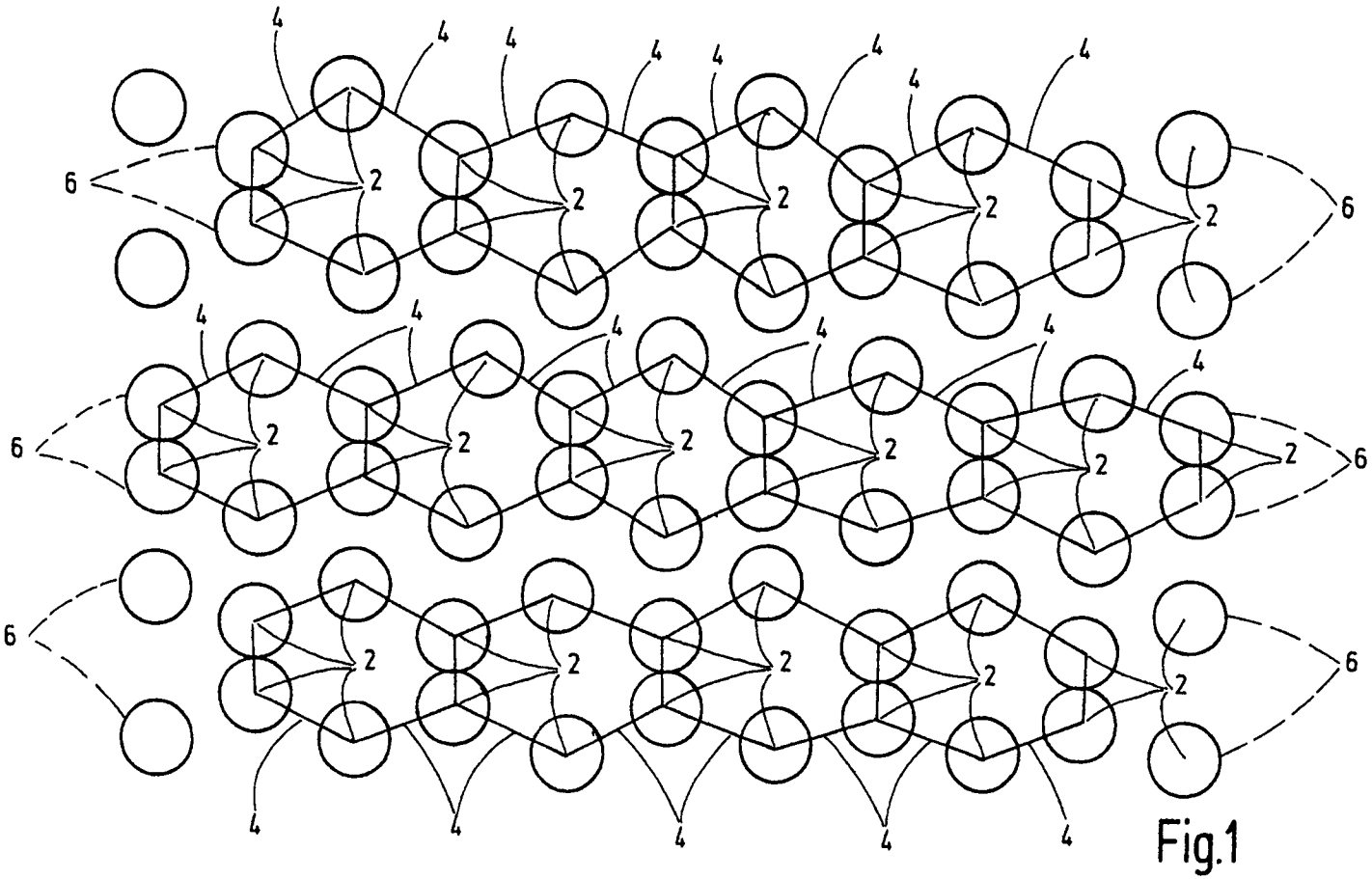
FIG. 1 is a highly schematically simplified and greatly enlarged top plan view of a touch-and-close fastener part with a pattern arrangement of adhesive elements according to a first exemplary embodiment of the invention.

FIG. 1 illustrates a pattern arrangement of the adhesive elements of a first exemplary embodiment of the touch-and-close fastener part according to the invention. Of the adhesive elements, in FIG. 1 circles indicate only the head parts 2 on the ends of the stems which are not visible to form mushroom head-shaped interlocking bodies. In the example of FIG. 1, the arrangement of the adhesive elements can be divided into groups 4, which depict a ring arrangement in the form of a hexagon with unequal sides. Its six corners are each occupied by the head part 2 of an adhesive element. The hexagonal shape has two shorter sides opposite one another, as a result of which the head parts 2 located on the corners of these short sides, meet or contact one another. Thus, within each group 4, two groupings of adhesive elements are formed, having one pair 6 of adhesive elements each. For the sake of clarity, not all of these pairs 6 of adhesive elements are numbered in FIG. 1. As FIG. 1 illustrates, a pattern arrangement is formed in which following groups 4 extending horizontally in the figure, groupings, formed from pairs 6 of adhesive elements, alternate with individual head parts 2, so that the head parts 2 which do not belong to pairs 6 have a greater distance from one another measured between the centers of the head parts than from the respectively adjacent pairs 6. As has been shown, this pattern arrangement in which "free-standing" head parts 2 alternate in the illustrated manner with groupings formed by pairs 6 of adhesive elements meeting one another on the head side, offers optimal conditions with respect to closure actuation by inducing the interlocking engagement with comparatively low expenditure of force, in spite of an arrangement of adhesive elements in high packing density of, for example, more than 150 adhesive elements per $cm^2$. In this type of pattern arrangement, the holding forces favorable for the performance characteristics can also be implemented.

Figure 2:
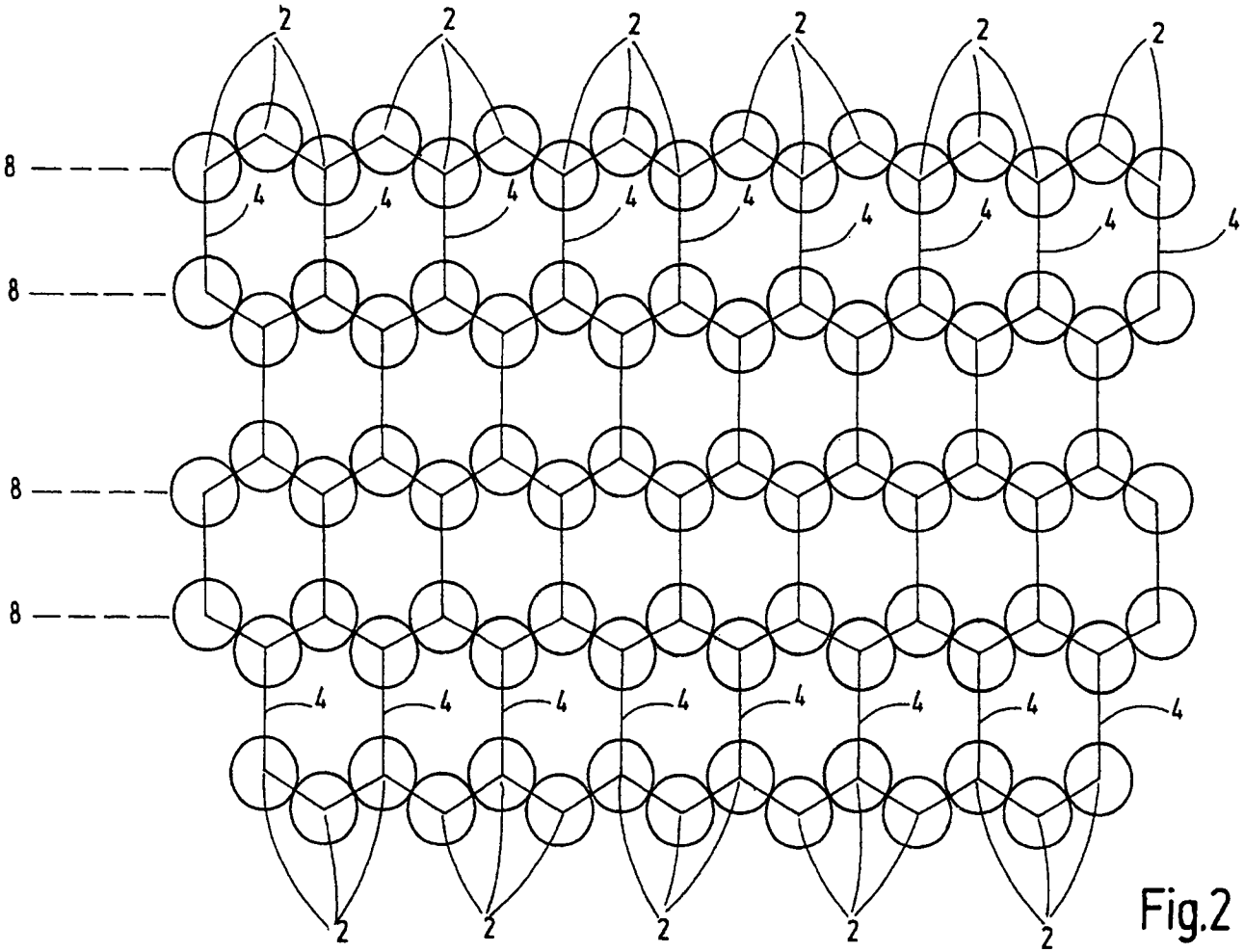
FIG. 2 is a highly schematically simplified and greatly enlarged top plan view of a touch-and-close fastener part with a pattern arrangement of adhesive elements according to a second exemplary embodiment of the invention.

FIG. 2 illustrates another exemplary embodiment in which groups 4 in turn define a ring arrangement in the form of a hexagon with unequal sides, whose corners are occupied by a head part 2 of a pertinent closure element. In the rectangular shape of FIG. 2, there are two long sides opposite one another, while there are two short sides between the long sides on each side. In turn, each corner is occupied by head part 2 of one adhesive element. Due to the reduced distance of the corners on the four shorter sides, on the three corners separated by the long sides, one grouping at a time is formed by a triplet of adhesive elements in which three head parts 2 meet or contact one another in sequence. Thus, in this exemplary embodiment, alternating rows 8 are formed of densely packed head parts 2, which alternate with rows which form free spaces. Depending on the choice of the length of the two long sides of the hexagonal shape and thus of the width of the free spaces formed between the rows 8, the properties of the closure can be optimized with respect to holding force and actuating force.

Figure 3:
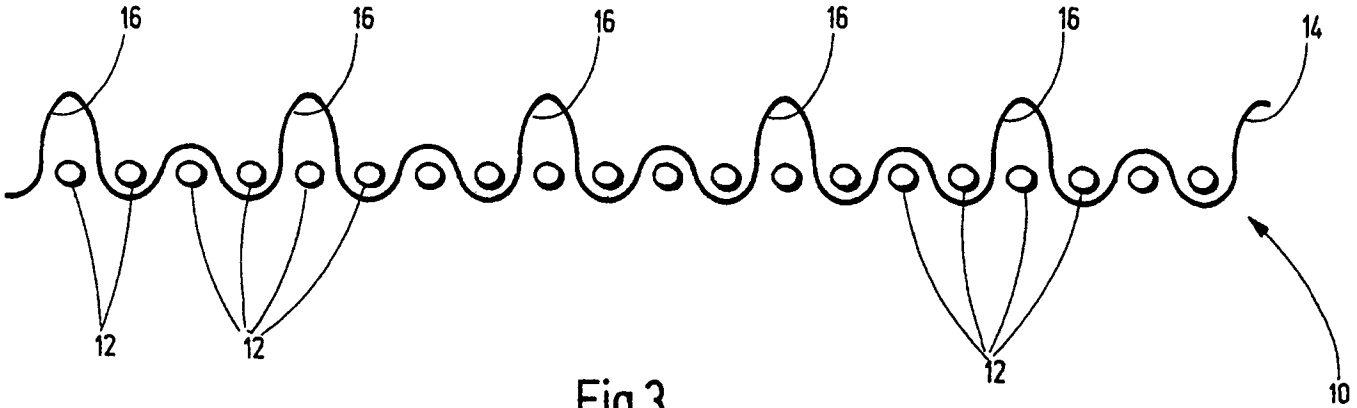
FIG. 3 is a schematic and highly enlarged side elevational view of a pile weave for producing the touch-and-close fastener part according to the invention, with only pile and warp threads being shown.

FIG. 3 illustrates only warp threads 12 (not all numbered) from the base fabric of a backing 10 which bears the adhesive elements, provided with pile threads 14 in the form of a W-weave. The pile threads 14 form loops 16 projecting over the base fabric. Warp, weft, and pile threads can be formed from an isotactic polypropylene. The warp and weft threads preferably are multifilaments, while the pile thread 14 is preferably made as a monofilament and has a diameter of approximately 0.20 mm. In these materials, adhesive elements can be formed from the loops 16 of the pile thread 14 by systems of the art known from DE 102 40 986 B3. When the loops 16 are cut by a thermal cutting process to form the adhesive elements, the free loop ends can be caused to shrink by further heating, with the ends being able to form closure bodies of preferably mushroom-like shape or also closure hooks.

At diameters of the pile thread 14 of approximately 0.20 mm, and for warp threads and weft threads which have 200 and 110 dtex respectively, packing densities of the formed adhesive elements of more than $150/cm^2$ can be implemented. The pickage for the weft threads, which are not shown in FIG. 3, can be in the region of 23/cm.

Instead of pile weaves in the form of a W-weave with a gauze weave pair, other types of weaves and/or that any appropriate plastic materials are suitable, especially for the base fabric of the backing 10.

While various embodiments have been chosen to illustrate the invention, it will be understood by those skilled in the art that various changes and modifications can be made therein without departing from the scope of the invention as defined in the appended claims.

What is claimed is:

1. A mechanical touch-and-close fastener, comprising a backing; and a plurality of adhesive elements having stems extending from said backing and having head parts on free ends of said stems, said adhesive elements being arranged and subdivided into groups forming imaginary hexagonal rings including at least two unequal sides with each said group having first, second and third pairs of head parts of said adhesive elements, said hexagonal rings each having corners thereof occupied by one of said adhesive elements, said first and second pairs of said head parts of said adhesive elements in each of said groups contacting one another in an unactuated state thereof, in each said group two head parts in each of two said first and second pairs thereof having centers thereof being spaced apart by a first distance, said head parts of said third pair in each said group being located between said first and second pairs and having centers being spaced by a second distance greater than said first distance, at least two spaces between respective ones of said head parts in each said group being without a head part in said spaces.

2. A mechanical touch-and-close fastener part according to claim 1 wherein each of said groups is formed by said first and second pairs of head parts contacting one another and said third pair of head parts that do not contact another of said head parts, said third pair having the head parts spaced by the second distance.

3. A mechanical touch-and-close fastener part according to claim 1 wherein each of said groups has two sets of three head parts contacting one another in a sequence.

4. A mechanical touch-and-close fastener part according to claim 1 wherein said head parts are shaped as mushroom heads.

5. A mechanical touch-and-close fastener part according to claim 1 wherein said adhesive elements are formed of isotactic polypropylene.

6. A mechanical touch-and-close fastener part according to claim 1 wherein said backing comprises a fabric of warp, weft and pile threads, said pile threads having loops projecting from a base of said fabric and being cut and thermally treated to form said adhesive elements with said head parts.

7. A mechanical touch-and-close fastener part according to claim 6 wherein said pile threads form a W-weave.

8. A mechanical touch-and-close fastener part according to claim 6 wherein said warp on weft threads are multifilaments; and said pile threads are monofilaments.

9. A mechanical touch-and-close fastener part according to claim 8 wherein each of said pile threads has a diameter of approximately 0.20 mm.

10. A mechanical touch-and-close fastener part according to claim 6 wherein said warp and weft threads have 200 and 110 dtex, respectively; and said weft threads have a pickage of approximately 23 pick per cm.

11. A mechanical touch-and-close fastener part according to claim 8 wherein each said group consists of six adhesive elements without any other adhesive elements therebetween.

12. A mechanical touch-and-close fastener, comprising a backing; and a plurality of adhesive elements having stems extending from said backing and having head parts on free ends of said stems, said adhesive elements being arranged and subdivided into groups forming imaginary hexagonal rings including at least two unequal sides with each said group having first, second and third pairs of head parts of said adhesive elements, said hexagonal rings each having corners thereof occupied by one of said adhesive elements, in each said group two head parts in each of said first and second pairs thereof having centers thereof being spaced apart by a first distance, said head parts of said third pair being located between said first and second pairs and having centers thereof being spaced by a second distance greater than said first distance, said adhesive elements being arranged on said backing in a packing density of at least 150/cm$^2$, at least two spaces between respective ones of said head parts in each said group being without a head part in said spaces.

13. A mechanical touch-and-close fastener part according to claim 12 wherein each of said groups is formed by said first and second pairs of head parts contacting one another and said third pair of head parts that do not contact another of said head parts, said third pair having the head parts spaced by the second distance.

14. A mechanical touch-and-close fastener part according to claim 12 wherein each of said groups has two sets of three head parts contacting one another in a sequence.

15. A mechanical touch-and-close fastener part according to claim 12 wherein said head parts are shaped as mushroom heads.

16. A mechanical touch-and-close fastener part according to claim 12 wherein said adhesive elements are formed of isotactic polypropylene.

17. A mechanical touch-and-close fastener part according to claim 12 wherein said backing comprises a fabric of warp, weft and pile threads, said pile threads having loops projecting from a base of said fabric and being cut and thermally treated to form said adhesive elements with said head parts.

18. A mechanical touch-and-close fastener part according to claim 17 wherein said pile threads form a W-weave.

19. A mechanical touch-and-close fastener part according to claim 17 wherein said warp on weft threads are multifilaments; and said pile threads are monofilaments.

20. A mechanical touch-and-close fastener part according to claim 19 wherein each of said pile threads has a diameter of approximately 0.20 mm.

21. A mechanical touch-and-close fastener part according to claim 19 wherein said warp and weft threads have 200 and 110 dtex, respectively; and said weft threads have a pickage of approximately 23 pick per cm.

22. A mechanical touch-and-close fastener part according to claim 12 wherein each said group consists of six adhesive elements without any other adhesive elements therebetween.

* * * * *